US006508568B1

(12) United States Patent
Blue-Recio

(10) Patent No.: US 6,508,568 B1
(45) Date of Patent: Jan. 21, 2003

(54) LIGHT ASSEMBLY FOR THE INTERIOR OF A PURSE

(76) Inventor: Brenda Robinson Blue-Recio, 20110 NW. 62nd Ave., Hialeah, FL (US) 33015

( * ) Notice: Subject to any disclaimer, the term of this patent is extended or adjusted under 35 U.S.C. 154(b) by 0 days.

(21) Appl. No.: 09/638,291

(22) Filed: Aug. 14, 2000

Related U.S. Application Data

(60) Provisional application No. 60/150,425, filed on Aug. 24, 1999.

(51) Int. Cl.[7] ..... A45C 15/06; F21V 33/00
(52) U.S. Cl. ..... 362/156; 362/200
(58) Field of Search ..... 362/156, 200

(56) References Cited

U.S. PATENT DOCUMENTS

| | | | | |
|---|---|---|---|---|
| 2,218,396 A | | 10/1940 | Hallbauer | |
| 4,442,478 A | * | 4/1984 | Stansbury | 362/489 |
| 4,654,763 A | | 3/1987 | Knight | |
| 4,954,934 A | | 9/1990 | Kidder et al. | |
| 5,005,111 A | | 4/1991 | Teal | |
| 5,038,271 A | * | 8/1991 | LaBello | 362/154 |
| 5,424,926 A | | 6/1995 | Myers | |
| 5,444,605 A | | 8/1995 | Rivera | |
| 5,718,498 A | * | 2/1998 | Pullman | 362/31 |
| 5,764,132 A | * | 6/1998 | Hill | 340/321 |

* cited by examiner

*Primary Examiner*—Thomas M. Sember
*Assistant Examiner*—David V. Hobden
(74) *Attorney, Agent, or Firm*—Malloy & Malloy, P.A.

(57) ABSTRACT

A light assembly designed to be mounted within and illuminate an interior portion of a purse, pocketbook or like structure including a casing having a substantially hollow interior, the boundaries of which are defined by a surrounding, exterior wall at least partially formed from a transparent or light transmitting portion. A circuit assembly including an illumination source, a power source and a switch assembly is mounted, at least partially, within the interior of the casing such that the illumination source is aligned with the light transmitting portion so as to generate light from the casing into interior portions of the purse for illumination thereof. A mounting structure is secured, at least in part, to the exterior wall and, dependent upon the specific structural embodiment thereof the casing may be permanently or removably connected to any one of a variety of different positions within the interior of the purse. The casing further includes an access opening cooperatively structured with a closure assembly and selectively disposable, as by sliding, between an open position and a closed position relative to the access opening thereby providing access to the operative components within the casing for repair, maintenance or replacement.

16 Claims, 2 Drawing Sheets

LIGHT ASSEMBLY FOR THE INTERIOR OF A PURSE

CLAIM OF PRIORITY

The present application is based on and a claim to priority is made under 35 U.S.C. Section 119(e) to provisional patent application currently pending in the U.S. Patent and Trademark Office having Ser. No. 60/150,425 and a filing date of Aug. 24, 1999.

BACKGROUND OF THE INVENTION

1. Field of the Invention

This invention relates to an illumination assembly designed to be mounted on the interior of a purse, pocketbook, backpack, briefcase or like structure. The illumination assembly includes a casing which is sufficiently small in size to occupy a minimum amount of interior space within a purse, etc. and further, includes an electric circuit assembly designed to selectively activate an illumination source through manipulation of an actuating member. As such, light can be generated by the assembly from the casing to interior portions of the purse, and thereby, facilitate the location of keys, coins, writing instruments and other items typically carried within a purse, pocketbook, backpack, briefcase, etc.

2. Description of the Related Art

The carrying of pocketbooks, purses, hand bags, etc. by women is and has been prevalent for many years. In addition, the use of pouches, satchels, backpacks and other objects for carrying various types of articles has become increasingly popular, not only with women but with men, as well as children, in more recent years. In today's fast-paced society, there has been a tendency for the size and capacity of such structures to increase in order to accommodate an increasing number of generally larger devices, such as but not limited to, portable telephones, sound recorders, radios and like electronic instruments, which were not commonly available in reduced sizes in years past. While these sorts of larger devices are capable of being easily located on the interior of a pocketbook, purse, backpack, etc., the smaller, somewhat more conventional items such as keys, coins, and like articles are frequently more difficult to locate because of their size, and also because they are frequently covered by the larger, heavier articles.

In recognition of this problem, some have resorted to carrying a hand-held, relatively small, portable "flash light" or like illumination instrument, which may also be stored on the interior of the purse or like structure, and which is primarily used to illuminate the purse interior for the location of the smaller, hard to find articles, as set forth above. One problem associated with the use of such smaller flash lights, however, is the tendency for them to also become misplaced on the interior of the purse or like structure, thereby delaying and making even more complicated the locating of smaller articles within the purse.

More sophisticated attempts to overcome the problem described above involve the use of relatively small illumination devices secured to the interior of a purse or the like. Typically, such illumination devices are manually or automatically activated to generate light, while one searches for one or more articles through the contents stored on the purse interior. While it may be assumed that the various, known illumination devices are operable for their intended function, additional problems arise relating to the complexity, cost, efficiency and overall reliability of such devices. For example, some of the known devices are expensive and overly complicated in that they include components such as specific light transmitting lenses, complex switching assemblies, and automatic actuation devices structured to control the flow of current from a battery or other self contained power source to one or more electric bulbs. In addition, such devices are relatively fragile and oftentimes cannot withstand the inadvertent abuse to which they are subjected on the interior of a purse, pocketbook, etc. Also, the existence of numerous components associated with such known devices have resulted in their having to be disposed within a bulky or somewhat oversized housing, thereby rendering such devices inconvenient for effective mounting or attachment on the interior of a purse or like structure.

As such, there remains a need in the art for an effective, durable illumination assembly having a somewhat simplified construction, thereby increasing its reliability and decreasing the cost associated with both purchase and maintenance. Further, any such improved illumination assembly developed should be capable of being permanently mounted at a single location, but more preferably, would be capable of being removably mounted at a variety of locations on the interior of a purse or pocketbook or—even within any one of a plurality of purses or pocketbooks, etc.,—so as to allow for the most effective illumination of the interior of a pocketbook, purse, pouch, nap sack, etc, regardless of its size and overall configuration.

SUMMARY OF THE INVENTION

The present invention is directed to an illumination assembly designed to be mounted within and illuminate the interior of a purse, pocketbook, pouch, backpack or other applicable storage structure, generally of the type carried by a person. of course, the light assembly of the present invention could be varied in dimension and/or configuration and otherwise be structurally adapted for use in the illumination of other structures, not necessarily limited to a purse, pocketbook, etc., such as brief cases, book bags, daily planners, etc. which are designed to store a plurality of diverse objects, some of which are sufficiently small in dimension to render them relatively difficult to find on the interior of such a storage structure.

More specifically, the illumination assembly of the present invention, also referred to herein as a light assembly, includes a casing having an interior, the boundaries of which are at least partially defined by an exterior wall. Operative components of the light assembly include a circuit assembly, at least partially mounted within the casing interior and comprising an illumination source, which is preferably in the form of at least one light bulb electrically connected to a power source, such as a dry cell battery. The circuit assembly also includes a switch assembly which is disposed and structured to regulate current flow between the power source and the illumination source.

The switch assembly, depending upon the particular embodiment utilized, may comprise a "momentary" switch assembly incorporating an actuating member which is at least partially exteriorly accessible and which is normally biased into a "circuit open" position. Depression of the actuating member against the aforementioned biasing force will serve to dispose the switch assembly in a "circuit closed" position, whereby current flows to the electric bulb for illumination thereof. Alternately, the switch assembly may include an "on-off" switch, wherein the light bulb is activated and illuminated by an initial depression or "push" of an actuating member. The illumination of the light bulb is maintained until specifically de-activated as the actuating member is again, subsequently "pushed", thereby disposing the switch assembly in the "circuit open" position.

The casing of the illumination assembly further comprises an access opening which is preferably dimensioned and disposed to provide easy access to the various components mounted within the casing interior, including but not limited to the circuit assembly. Replacement of a battery or light bulb, repair and/or be cleaning or other maintenance is thereby facilitated of the various operative components disposed within the casing interior. A closure assembly is associated with the access opening and includes a closure member movably mounted on the casing and selectively positionable between a closed position and an open position relative to the access opening.

Further, the exterior wall of the casing is also structured to at least partially include a transparent portion or a similar, equivalent type of material portion through which light may be transmitted. For purposes of conveniently locating the transparent or light transmitting portion, the closure member may be formed to be a movable part of the exterior wall of the casing, such that the light transmitting portion can be formed on the closure member or alternately, on some other part of the exterior wall of the casing. However, regardless of the specific structural embodiment, the illumination source which, as set forth above, is defined as part of the circuit assembly, is disposed in generally aligned relation with the transparent or light transmitting portion of the exterior wall of the casing. As such, light generated by the illumination source easily passes through the aligned, light transmitting portion of the exterior wall, so as to illuminate the interior of the purse, pocketbook, etc. in which it is mounted, in a comprehensive manner.

Further structural features of the light assembly of the present invention include a mounting structure which, depending upon the particular embodiment utilized, may attach the light assembly in a substantially permanent manner at a fixed location within the interior or alternatively, may provide for the selective removable positioning and attachment of the casing at any one of a variety of different locations, as desired. Therefore, illumination issuing from the casing may be substantially concentrated on a particular area within the interior of the purse while concurrently allowing for a majority of the purse interior to be at least partially illuminated. In addition, the embodiment wherein the light assembly is removably mounted permits the utilization of the assembly within a variety of purses or other carryable structures.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 2:
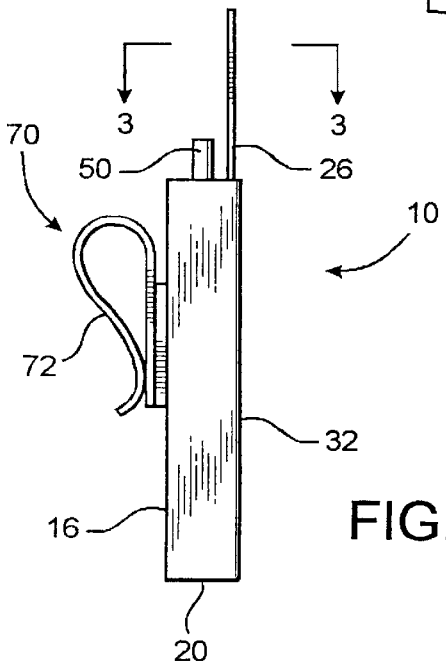
FIG. 2 is a side view of the embodiment of FIG. 1 with a closure assembly associated with the present invention, disposed in an at least partially open position.
Figure 4:
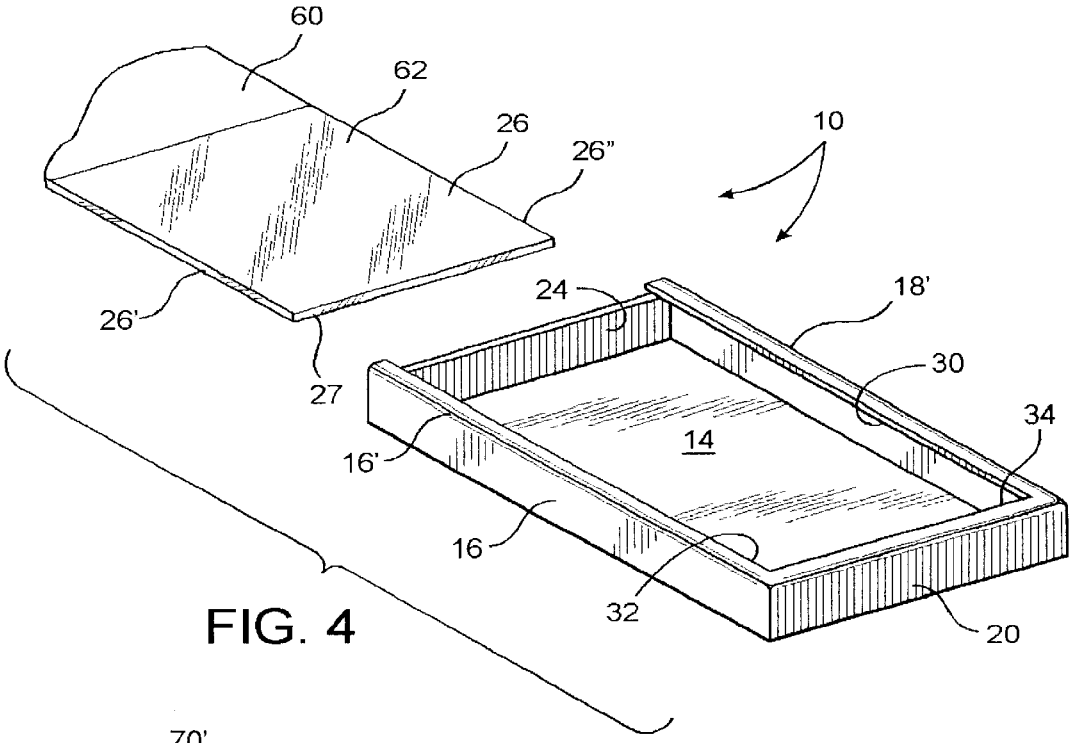
FIG. 4 is a perspective view in exploded, partial cut away form.

As shown in the accompanying drawings, the present invention is directed to an illumination assembly, also referred to herein as a light assembly, generally indicated as 10, which includes a casing 12 having a relatively small dimension and overall configuration so as to allow it to be easily mounted or temporarily attached within an interior of a purse, pocketbook, pouch, knapsack, or like article, generally but not exclusively, of the type carried by a person. While the overall configuration of the casing 12 may vary, it preferably includes a hollow interior 14 bounded by a substantially surrounding exterior wall. The exterior wall may be defined by a plurality of interconnected wall portions including sidewalls 16 and 18, top wall 19, bottom wall 20 and a rear wall or face 21. As best shown in FIGS. 2 and 4, the exterior wall of the casing 12 also includes an access opening 24, which in the embodiment shown, substantially defines the entire front or outer exposed portion of casing 12.

Figure 1:
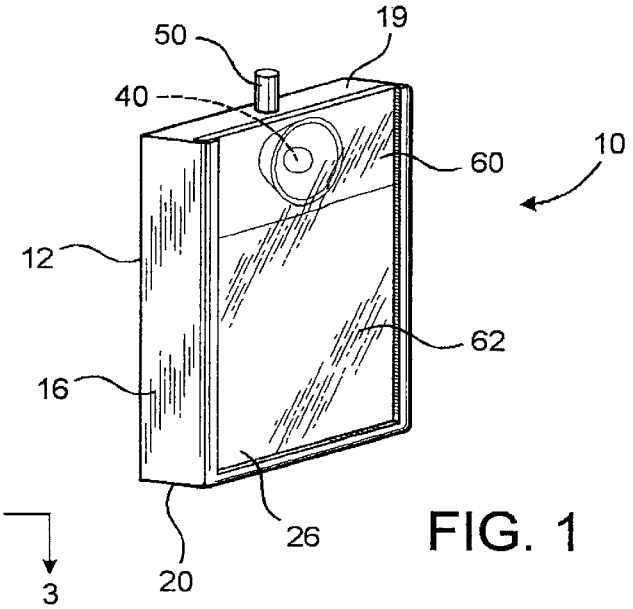
FIG. 1 is a perspective view of the light assembly of the present invention.

The light assembly includes a closure assembly, which comprises a closure member 26 and structural means, as best shown in FIG. 4 for removably, or at least movably mounting or connecting the closure member 26 to the casing 12 and allowing its selective positioning between an open position as shown in FIG. 4 or a closed position as shown in FIG. 1. Therefore, the closure assembly in the embodiment of FIG. 4, includes a connecting structure in the form of spaced apart, substantially parallel tracks 30 and 32 extending along at least a majority of the length of the outer exposed peripheral edges 16' and 18' of the respective longitudinal side walls 16 and 18 of the exterior wall of casing 12. The connecting structure of the embodiment of FIG. 4 also includes a stop portion 34 positioned to engage the lower or end most peripheral edge 27 of the closure member 26. By virtue of the disposition of the stop portion 34, and the corresponding lengths of the closure member 26 and access opening 24, the closure member 26 will be disposed in aligned, overlying and completely covering relation to the access opening 24 when edge 27 engages stop portion 34. In addition, the track it members 30 and 32 are dimensioned and configured so as to at least partially surround, slidingly engage and support the respective peripheral edges 26' and 26" of the closure member 26 along at least the majority of the length of the closure member 26.

The light assembly 10 of the present invention further comprises a circuit assembly including an illumination source, which preferably, is in the form of an electric bulb 40 removably connected to base 42 and interconnected by appropriate conductors 44 to a power source, generally indicated as 46, which preferably is in the form of one or more dry cell batteries. In one preferred embodiment, the light bulb 40 may be in the form of a MINIMAGLITE® which is designed to be powered by at least one but preferably two, dry cell, AAA size batteries. The circuit assembly of the present invention further comprises a switch assembly schematically represented in FIG. 5 and generally indicated as 48. The switch assembly 48 includes a switch member 49 and an actuating member, preferably in the form of a button 50, being at least partially exteriorly accessible. As shown in the accompanying Figures, the actuating button 50 preferably but not necessarily extends exteriorly through a top most wall 19 of the exterior wall of casing 12. The switch assembly may also include a biasing spring 52 mounted to normally dispose or bias the actuating button 50 in a "circuit open" position as disclosed in FIG. 5. Further, the embodiment of FIG. 5 preferably comprises a "momentary switch" wherein a downward force exerted on the actuating button 50, as indicated by directional arrow 54 forces the switch member 49 to be disposed into a "closed" circuit position represented in phantom lines and indicated as 49'. As long as the force 54 is exerted in a downward direction on the actuating button 50, the switch member 49 will be maintained in the circuit closed position as at 49'. However, release of the force 54 will cause the biasing spring 52 to force the actuating button 50 back into a circuit open position, thereby stopping current flow from the power source 46 to the illumination force 40. Alternatively, the switch assembly 48 may be in the form of a push-type "on/off" structure. In such an embodiment, a downward force 54 exerted on the actuating member 50 will cause the switch member 49 to overcome the biasing force of spring 52 and be maintained in the circuit closed position 49', even after the force 54 is removed. Selective positioning of the circuit assembly into the aforementioned circuit open position will be accomplished by a second, subsequent downward force 54 being exerted on the actuating member 50, causing its release.

Figure 5:
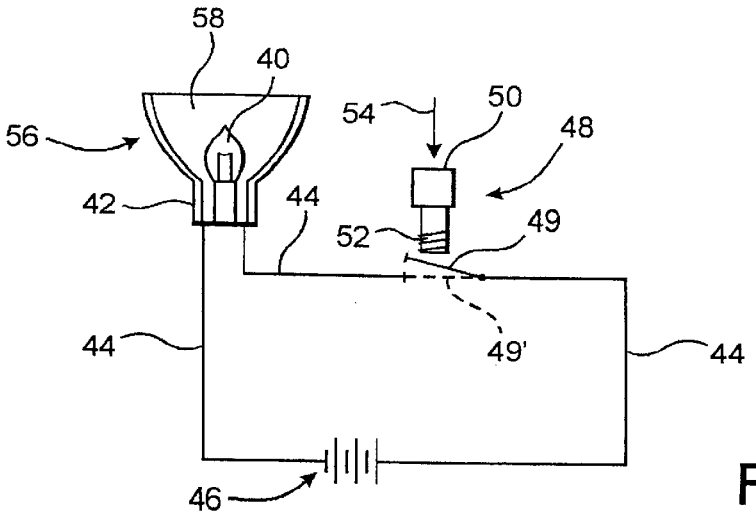
FIG. 5 is a schematic representation of a circuit assembly associated with the light assembly of the present invention.

As also shown in FIG. 5, the illumination source may also include a reflector structure, generally indicated as 56. The reflector structure preferably includes a reflective interior it surface 58 having a somewhat concave configuration disposed in surrounding relation to the electric bulb 40. The reflective surface 58 serves to amplify, as well as channel or direct the illumination generated by the illumination source 40, so that a significant interior portion of the purse, pocketbook, etc. may be illuminated, as well as directing a significant portion of the generated illumination to a specific or "focused" area within the interior.

Another feature of the present invention is the inclusion of a transparent or like material portion 60 formed or mounted at a preferred location on the exterior wall of the casing 12, such that the portion 60 is aligned in generally overlying or otherwise communicating relation with the illumination source 40. Light generated from illumination source 40 may readily pass through the transparent portion 60 so as to illuminate intended interior portions of a purse, etc. The term "transparent" is, of course, meant to encompass a variety of materials which allow light to be transmitted therethrough. Alternatively, there may be an absence of any material in overlying relation to the illumination source 40, wherein the illumination generated by the illumination source 40 may pass through a specifically disposed opening. It is further emphasized that while the transparent or light transmitting material portion 60 is shown formed on the closure member 26, the portion 60 could be formed on any other location on the casing 12, as long as it is disposed in aligned relation with the illumination source 40, so as to allow light generated thereby to pass out of the interior 14 of the casing 12 and illuminate the interior of the purse, pocketbook, etc.

The remaining portion of the closure member 26, as at 62, may be formed of an opaque or sufficiently translucent material to hide the other operable components from view, including but not limited to the circuit assembly as shown in FIG. 5, within the interior 14 of the casing. Similarly, the remaining portions 16, 18, 19, 20 and 21 of the exterior wall of the casing 12 may be formed of a material which restricts the viewing into the interior 14 so that the various operable components may not be readily seen. Ideally, the opaque material will be formed of a black colored, acrylic or plexiglass type of material so as to camouflage the presence of the assembly within the purse.

Figure 3:
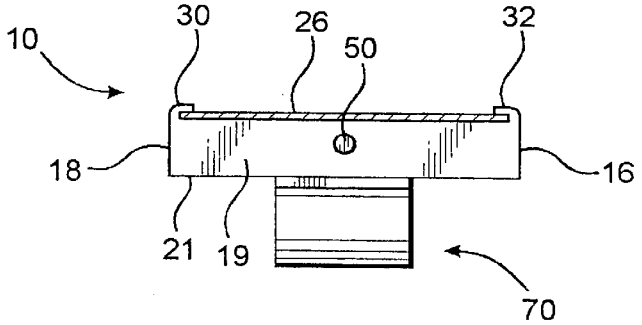
FIG. 3 is a top partially sectional view taken along line it 3—3 of FIG. 2.
Figure 6:
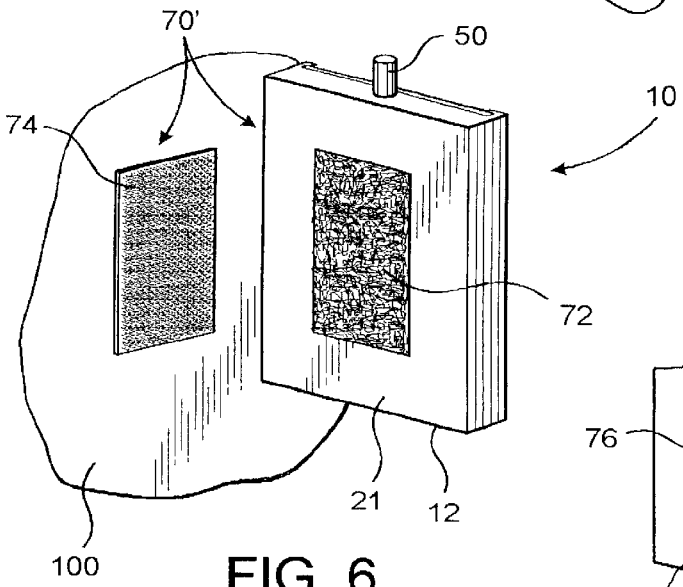
FIG. 6 is a perspective view in partial cutaway showing one embodiment of a mounting structure of the present invention.

Another feature of the present invention is directed towards a mounting structure which, in the embodiment of FIGS. 2 and 3, preferably includes a clip generally indicated as 70 formed of a plastic, metal or other material having an inherit bias which provides a spring like action to the clip 72, thereby facilitating its removable mounting or attachment to any of a variety of portions of the interior of a purse, pocketbook, etc. or to a variety of different purses, briefcases, etc. With reference to FIG. 6, an alternative embodiment 70' of the mounting structure includes a first and second component 72 and 74, respectively. The first component 72 is secured to the casing 12 such as by attachment to the rear surface 21 and a second component 74 fixedly or otherwise attached to an interior portion 100 of a purse, pocketbook, etc. as shown. The first and second mounting components 72 and 74 may take a variety structural configurations including hook and loop type fasteners, snaps, etc. which allows the removable mounting of the casing 12 in any one of a variety of locations, dependent on what areas of the interior of the pocketbook, purse, etc., the user wishes to primarily illuminate.

Figure 7:
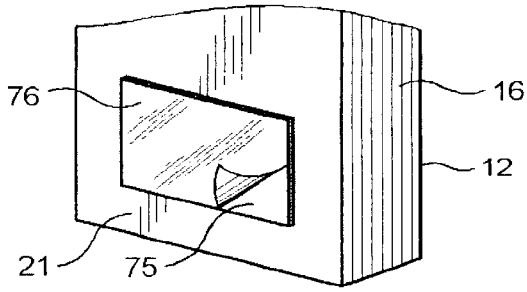
FIG. 7 is a perspective view in partial cutaway of another embodiment of the mounting structure of the present invention.

FIG. 7 is directed to yet another embodiment of the mounting structure, wherein an adhesive coating and/or section 75 is secured to the surface 21, or other portions of the casing 12 and is initially covered by a removable, protective sheet 76 for purposes of preventing inadvertent contact with the adhesive section 75. The adhesive section 75 may include a type of adhesive specifically designed to establish either a permanent or removable attachment to the liner portion of the interior of a purse as at 100 or to any one of a variety of other objects which may be stored within the purse.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A light assembly designed to be mounted within an interior of a purse, said assembly comprising:

a) a casing including an exterior wall disposed in at least partially surrounding relation to a casing interior, b) a circuit assembly removably mounted, at least in part within said casing interior and including an illumination source, c) said circuit assembly further including a power source and a switch assembly electrically connected to one another and to said illumination source to collectively define an operative electrical circuit, d) an access opening formed in said casing and dimensioned to allow passage of at least a portion of said circuit assembly there through into and out of said casing interior, e) a closure assembly including a closure member movably connected to said casing, said closure member selectively positionable between a closed position and an open position relative to said access opening, f) said closure member further including a light transmitting portion disposed thereon and movable therewith between said closed and open positions, g) said light transmitting portion disposed in aligned, outwardly spaced relation to said illumination source and cooperatively structured therewith to illuminate portions of the purse interior when said closure member is in said closed position, and h) a mounting structure secured to said exterior wall and disposed and structured to supportingly attach said casing to anyone of a plurality of interior portions of the purse.

2. An assembly as recited in claim 1 wherein said mounting structure comprises at least a first component secured to said exterior wall and structured for removable attachment to the purse interior.

3. An assembly as recited in claim 2 wherein said first component comprises a spring biased clip dimensioned and configured for removable securement to any one of a plurality of interior portions of the purse.

4. An assembly as recited in claim 2 wherein said mounting structure comprises a second component fixedly secured to the purse interior and removably attachable to said first component in supporting relation to said casing.

5. An assembly as recited in claim 4 wherein said first and second components comprise hook and loop type fasteners.

6. An assembly as recited in claim 1 wherein said mounting structure comprises an adhesive fixedly interconnecting said casing to the purse interior.

7. An assembly as recited in claim 1 wherein said actuating member comprises a button movably mounted on said casing and extending outwardly from said casing interior.

8. An assembly as recited in claim 7 wherein said actuating member is normally biased into said circuit-open position, and selectively positionable against the biasing force into said circuit-closed position.

9. An assembly as recited in claim 8 wherein said button is cooperatively structured with a remainder of said switch assembly to define a momentary switch.

10. A light assembly as recited in claim 1 further comprising an opaque portion disposed on said closure member in covering relation to at least a portion of said circuit assembly when said closure member is in said closed position.

11. A light assembly as recited in claim 10 wherein said light transmitting portion is disposed adjacent said opaque portion and is formed of a transparent material.

12. A light assembly as recited in claim 10 wherein said light transmitting portion is disposed adjacent said opaque portion and comprises an opening formed in said closure member.

13. A light assembly as recited in claim 1 wherein said closure assembly further comprises a connecting structure mounted on said casing and movably interconnecting said closure member to said casing; said closure member slidingly supported on said casing relative to said access opening by movable engagement with said connecting structure and being selectively positionable between said open and closed positions.

14. An assembly as recited in claim 13 wherein said connecting structure comprises two linearly elongated tracks disposed in spaced, substantially parallel relation to one to another, each track disposed to slightingly engage a different peripheral portion of said closure member.

15. An assembly as recited in claim 14 wherein said tracks extend contiguously along spaced apart peripheral portions of said access opening.

16. A light assembly as recited in claim 1 wherein said illumination source comprises at least one miniaturized bulb electrically connected to said power source, said circuit assembly further comprising a reflector structure having a substantially conically configured reflective surface disposed in surrounding relation to said miniaturized bulb; said reflector structure and said miniaturized bulb disposed in outwardly facing relation to said closure member and in spaced underlying relation to said light transmitting portion when said closure member is in said closed position.

* * * * *